US006685061B2

(12) United States Patent
Wolf et al.

(10) Patent No.: US 6,685,061 B2
(45) Date of Patent: Feb. 3, 2004

(54) TAMPER EVIDENT VALVE OUTLET CAP

(75) Inventors: Erich F. Wolf, Mansfield, OH (US); Steven R. Peabody, Zionsville, IN (US)

(73) Assignee: Worthington Cylinder Corporation, Columbus, OH (US)

( * ) Notice: Subject to any disclaimer, the term of this patent is extended or adjusted under 35 U.S.C. 154(b) by 161 days.

(21) Appl. No.: 10/015,146

(22) Filed: Nov. 9, 2001

(65) Prior Publication Data

US 2002/0070236 A1 Jun. 13, 2002

Related U.S. Application Data

(63) Continuation-in-part of application No. 09/735,014, filed on Dec. 12, 2000, now abandoned.

(51) Int. Cl.[7] ..... B67D 47/10

(52) U.S. Cl. ..... 222/153.06; 222/153.14; 222/541.05; 215/252

(58) Field of Search ..... 222/548, 541.1, 222/541.5, 541.6, 153.01, 153.05, 153.06, 153.14; 220/DIG. 34; 215/250, 252, 253, 258

(56) References Cited

U.S. PATENT DOCUMENTS

| | | | | |
|---|---|---|---|---|
| 1,938,063 A | | 12/1933 | Burke | |
| 3,415,403 A | * | 12/1968 | Bardell | 215/252 |
| 3,795,337 A | | 3/1974 | Nozawa et al. | |
| 3,795,338 A | | 3/1974 | Swartzbaugh et al. | |
| 4,153,174 A | | 5/1979 | Keeler | |
| 4,372,456 A | | 2/1983 | Guala | |
| 4,454,955 A | | 6/1984 | Kusz et al. | |
| 4,503,986 A | | 3/1985 | Nixdorff et al. | |
| 4,527,701 A | | 7/1985 | Schaubeck | |
| 4,570,810 A | * | 2/1986 | Hawkins | 215/253 |
| 4,573,601 A | * | 3/1986 | Berglund | 215/252 |
| 4,630,743 A | * | 12/1986 | Wright | 215/216 |
| 4,667,836 A | | 5/1987 | McLaren | |
| 4,709,824 A | | 12/1987 | Thompson | |
| 4,801,028 A | | 1/1989 | Puresevic et al. | |
| 5,033,632 A | | 7/1991 | Mattia et al. | |
| 5,056,675 A | * | 10/1991 | Julian | 215/252 |
| 5,076,453 A | | 12/1991 | Odet | |
| 5,107,998 A | | 4/1992 | Zumbuhl | |
| 5,163,571 A | | 11/1992 | Morini | |
| 5,190,177 A | | 3/1993 | Collins | |
| 5,318,192 A | * | 6/1994 | Rebeyrolle et al. | 215/252 |
| 5,328,046 A | | 7/1994 | Kutz et al. | |
| 5,465,858 A | | 11/1995 | Gargione | |
| 5,667,085 A | | 9/1997 | Ogden et al. | |
| 6,089,418 A | * | 7/2000 | Gaiser et al. | 222/490 |

* cited by examiner

*Primary Examiner*—Gene Mancene
*Assistant Examiner*—Patrick Buechner
(74) *Attorney, Agent, or Firm*—Fay, Sharpe, Fagan, Minnich & McKee, LLP

(57) ABSTRACT

A tamper-evident closure assembly (22) for a valve outlet (16) of a pressurized gas cylinder, or the like includes a cap (50) and a tamper-evident ring (52, 140, 200, 240). The assembly is threadably attached to the outlet prior to shipment and removed by a customer prior to dispensing fluid through the outlet. The ring includes tabs (84, 146, 204, 242) which snap fit into slots (90) in the cap and cause the ring to rotate with the cap. Fins (100, 162, 206, 260) on the ring engage a surface of the valve outlet during cap removal. When sufficient force is applied in the cap removal direction, part of the ring is severed, such as the tabs or the fins. This provide evidence that the cap has been removed.

23 Claims, 9 Drawing Sheets

TAMPER EVIDENT VALVE OUTLET CAP

This application is a continuation-in-part of U.S. application Ser. No. 09/735,014, filed Dec. 12, 2000, now abandoned.

FIELD OF THE INVENTION

The present invention relates to a tamper evident cap. It finds particular application in conjunction with a valve outlet for a pressurized cylinder and will be described with particular reference thereto. It will be appreciated, however, that the cap is also suited to use with a variety of other fluid outlets.

BACKGROUND OF THE INVENTION

Tanks filled with pressurized gases, such as refrigerants for use in cooling systems, are generally supplied with a valve for sealing an outlet from which the fluid is dispensed. Because of the high cost of certain gases, such as chlorofluorocarbons (CFCs), it is common to incorporate some type of tamper-evident feature after filling the tank with refrigerant, which provides an indication of whether the valve has been opened. In the event that a customer reports that the tank is empty or suffering a loss of contents, the tamper-evident feature allows a supplier to determine whether the valve is leaking or whether the valve has been opened.

One current method used by suppliers is to fit a water-based transparent shrink-wrap sleeve over the valve handle and valve body. The sleeve is applied wet, and shrinks on drying. Another method incorporates a heat-shrink type of sleeve. It has been found, however, that the sleeve may sometimes be taken off and replaced without providing evidence of tampering, for example, by soaking the sleeve. A customer or other person in the chain of supply can thus remove the sleeve, relieve the refrigerant and then replace the sleeve to defeat the tamper evident device. Additionally, the heat-shrink version can sometimes become brittle and crack even when not subjected to tampering and thus provide a false indication of tampering.

There remains a need for an improved tamper-evident device for providing an indication of whether a refrigerant tank has been at least partially emptied or otherwise tampered with. The present invention provides a new and improved tamper-evident valve outlet cap and method of use which overcomes the above-referenced problems and others.

BRIEF SUMMARY OF THE INVENTION

In accordance with one aspect of the invention, a tamper-evident closure for an associated outlet is provided. The closure includes a cap which rotatably engages the outlet. A tamper evident ring is carried by the cap and has at least one projection, rotation of the cap in a cap removal direction being opposed by engagement of the at least one projection with a surface of the associated outlet until a portion of the ring or cap breaks, allowing the cap to be removed from the associated outlet.

In accordance with another aspect of the invention, a combination of closure assembly and an outlet is provided. The outlet has an internal bore with an opening for dispensing a fluid therefrom and a land on an exterior surface thereof. The closure assembly includes a cap configured for attachment to the outlet so as to cover the opening. A tamper-evident ring is operatively connected with the cap by at least one tab, the ring includes at least one projection for engaging the land on the outlet to resist removal of the cap from the outlet until movement of the cap in a cap removal direction breaks one or more of the tabs and/or projections.

In accordance with another aspect of the invention, a method of providing evidence of removal of a cap from an outlet is provided. The method includes rotatably engaging a cap with the outlet until at least one projection carried by the cap contacts a surface of the outlet. The projection resists rotation of the cap in a cap removal direction. The method further includes applying a sufficient force to the cap in the cap removal direction to cause a portion carried by the cap to break, allowing the cap to be removed from the outlet.

In accordance with another aspect of the invention, a tamper-evident closure for an outlet is provided. The closure includes a cap which rotatably engages the outlet. The cap includes a slot. The closure further includes a tamper evident ring including a tab and a projection. The tab includes a frangible portion and at least one finger that snap fits into the slot on the cap. Rotation of the cap in a cap removal direction is opposed by engagement of the projection with a surface of the outlet until the frangible portion of the tab breaks, allowing the cap to be removed from the outlet.

One aspect of the present invention is the provision of a tamper-evident closure for an outlet.

Another aspect of the present invention is the provision of a tamper-evident closure in which a tamper evident ring carried by a cap has at least one, and preferably a plurality of projections which oppose rotation of the cap until a portion of the ring breaks, providing evidence of tampering.

Still another aspect of the present invention is the provision of a tamper evident ring with at least one tab, and preferably a plurality of tabs, which snap fit into a slot or slots on the cap, the tabs breaking under applied rotational pressure as evidence that the closure has been removed.

Yet another aspect of the present invention is the provision of a tamper evident ring for a closure in which tabs on the ring each include a finger at a distal end thereof which passes through the slot on the cap to prevent removal the cap from the ring without breaking the tabs.

A further aspect of the present invention is the provision of a tamper-evident closure in which the tab or tabs extend from a first surface of an annular disk and the projection or projections extend from a second, opposite or side surface of the disk.

A still further aspect of the present invention is the provision of a tamper-evident closure in which the projections are formed from a cut-out portion of an annular disk.

A yet further aspect of the present invention is the provision of a tamper-evident closure in which projections on a tamper-evident ring each include a sliding portion and an engagement portion, allowing the closure to be rotatably engaged with an outlet by sliding of the sliding portions over a land, the engagement portions engaging the land when the closure is rotated in an opening direction.

A yet still further aspect of the present invention is the provision of a tamper-evident closure in which the engagement of tabs on a tamper-evident ring with the cap opposes rotation of the cap relative to the ring during rotation of the cap in the cap removal direction until a sufficient rotational force is applied to break the tabs.

A yet still further aspect of the present invention is the provision of a tamper-evident closure with a seal retained in a groove on an inner surface of the cap, the seal sealing the cap to the outlet.

Another aspect of the present invention is the provision of a closure assembly and an outlet, the closure including a tamper-evident ring operatively connected with a cap by at least one tab, the ring including a projection for engaging a land on the outlet to resist removal of the cap from the outlet until movement of the cap in a cap removal direction breaks the tab.

Yet another aspect of the present invention is the provision of a method of providing evidence of removal of a cap from an outlet.

Still other aspects of the present invention will become apparent to those skilled in the art upon a reading and understanding of the following detailed description.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
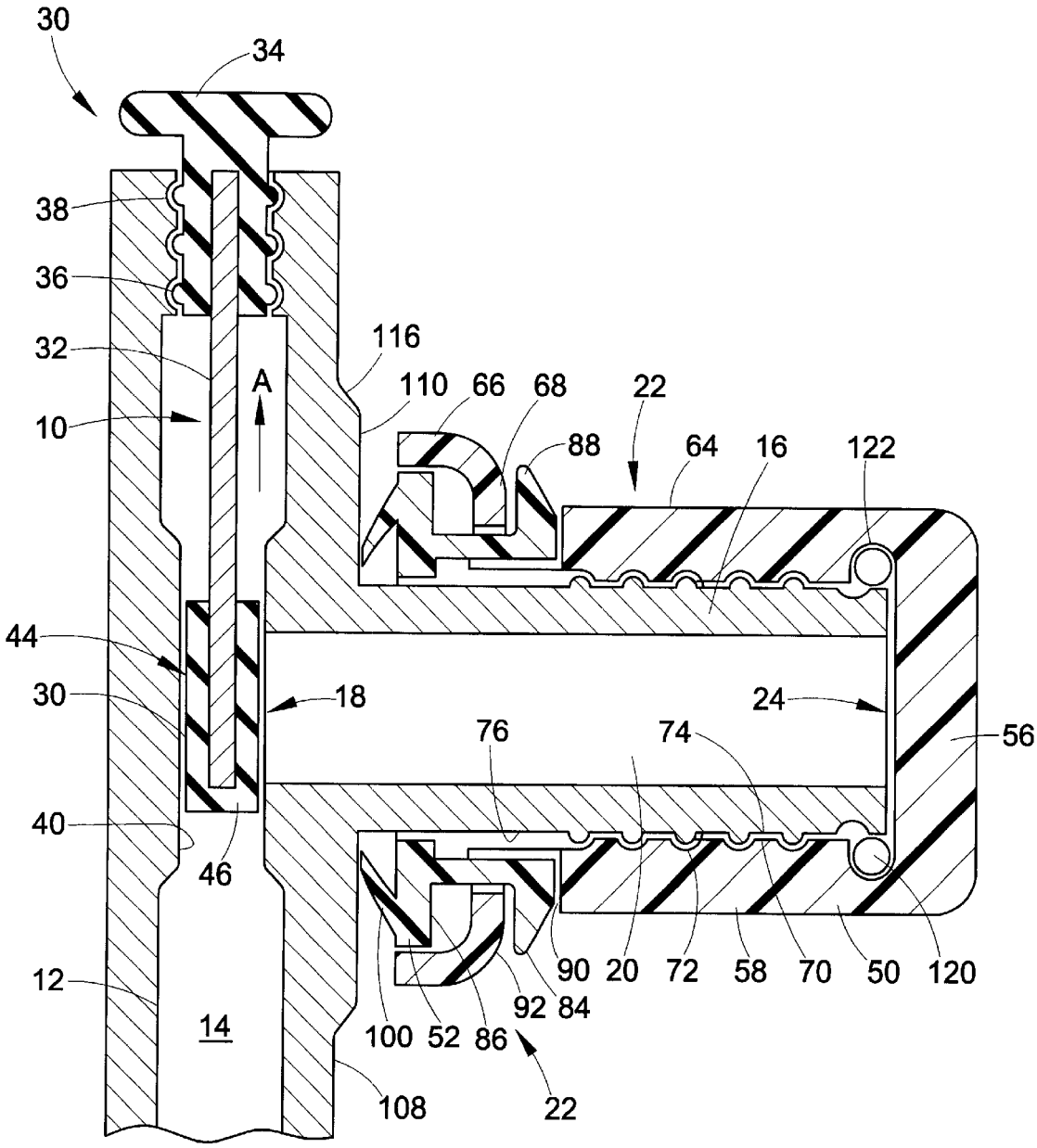
FIG. 1 is a side sectional view of a tamper evident closure fitted to a valve according to a first embodiment of the present invention.

Referring now to the drawings, wherein the showings are for purposes of illustrating preferred embodiments of this invention only, and not for purposes of limiting same, FIG. 1 shows a valve assembly 10 for a refrigerant cylinder (not shown). The valve assembly includes a tubular valve body 12, which defines a generally cylindrical central bore 14. The valve body may be integrally formed with the refrigerant cylinder, or attached to the cylinder by a screw thread, welding, or other pressure resistant method.

A valve outlet 16 extends generally perpendicular to the valve body. An opening 18 in the valve body fluidly connects the valve body bore 14 with a first end of an axial bore 20 defined within the outlet. The valve outlet is fitted with a tamper evident closure assembly 22 which covers an open end 24 of the outlet bore 20.

A valve sealing member 30 includes a valve stem 32, which is slidingly received within the valve bore 14 for axial movement within the valve bore and is adjusted axially by rotation of a valve handle 34 connected with an upper end of the valve stem for opening or closing access from the tank to the outlet bore. The valve stem (or the handle) has an exterior helical thread 36 which engages a suitably positioned thread 38 on an interior surface of the bore. As the handle is rotated, a lower end of the valve stem (the terms "upper" and "lower" being used in conjunction with the position of the valve as shown in FIG. 1) moves relative to the valve outlet opening 18. As shown in FIG. 1, the bore 14 has a narrowed portion 40, adjacent the opening 18, which provides a sealing region with an outer surface 44 of the lower end when the lower end enters the narrowed portion and seals the opening 18 from the valve bore 14. In this respect, the lower end may be widened and/or fitted with an annular seal 46 formed of a resilient material, such as rubber, therearound for creating the seal. Rotating the handle in an opposite direction raises the shaft in the direction of arrow A and uncovers the opening 18.

It should be appreciated that other sealing methods for selectively covering and uncovering the valve opening 18 are also contemplated.

Figure 2:
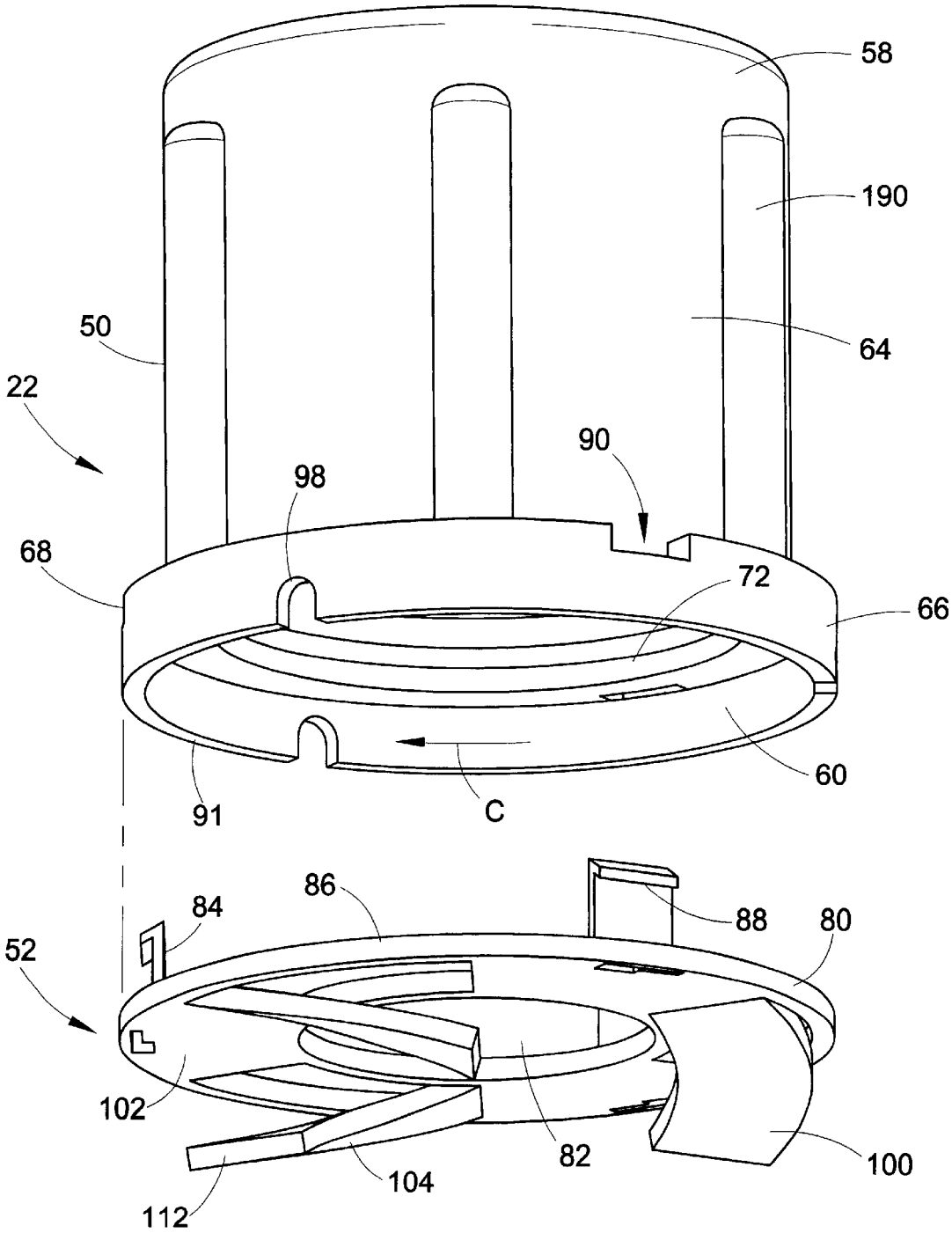
FIG. 2 is a exploded perspective view of the tamper evident closure of FIG. 1.

With continued reference to FIG. 1, the closure assembly 22 includes a cap 50 and a tamper-evident ring 52 which is readily connectable with the cap but which is not readily disconnected without evidence of its removal. The cap and ring are both formed from plastic or other suitable material. The cap includes a top end 56 with a cylindrical skirt 58 dependent therefrom. With reference now also to FIG. 2, the skirt defines an opening 60 through which the valve outlet 16 is received. The skirt includes a first wall portion 64, adjacent the top 56, and a second wall portion 66, of wider diameter than the first wall portion, adjacent the opening 60. The second wall portion is connected with the first wall portion by an annular shelf region 68, which extends generally perpendicularly to the first and second walls portions. As shown in FIG. 1, an inner surface 70 of the first wall portion 64 of the skirt defines a helical thread 72 for screwing onto a corresponding threaded portion 74 of an outer surface 76 of the valve outlet 16.

The tamper-evident ring includes an annular disk portion 80 with a central opening 82. The wider wall portion 66 of the skirt around the opening 60 is shaped to contact the disk portion 80. Alternatively, the wider wall portion 66 may receive the tamper evident ring 52 such that the ring contacts the shelf portion 68, within the cap, to limit movement of the ring. Resiliently flexible tabs 84 (three are shown in FIG. 2) extend generally perpendicularly from a first end surface 86 of the disc and are annularly spaced from each other. The tabs are each fitted with an outwardly extending finger 88 at a distal end thereof (a single finger is shown on each tab in FIG. 2, although it should be appreciated that each tab may have more than one finger). Each finger is received through a corresponding slot 90 (three for the embodiment of FIG. 2, although it should be appreciated that two or more fingers may be received in a single slot) in the shelf portion or adjacent wider wall portion 66 of the cap. As shown in FIG. 1, the slots 90 each extend right through the wall 66. Alternatively, the slots may take the form of indented regions of an inner surface 91 of the wider wall portion without cutting through to the exterior of the cap.

The tabs 84 are designed to flex to allow them to slide over the inner surface 91 of the wider wall portion of the cap during assembly and snap fit through the respective slots 90. As can be seen in FIG. 2, the wider wall portion 66 has its widest internal diameter adjacent the opening 60 and then the diameter decreases towards the slots. This guides the tab fingers inwardly as they move toward the slots creating a tension in the tabs which forces them outwardly again as the fingers reach the slots.

Figure 3:
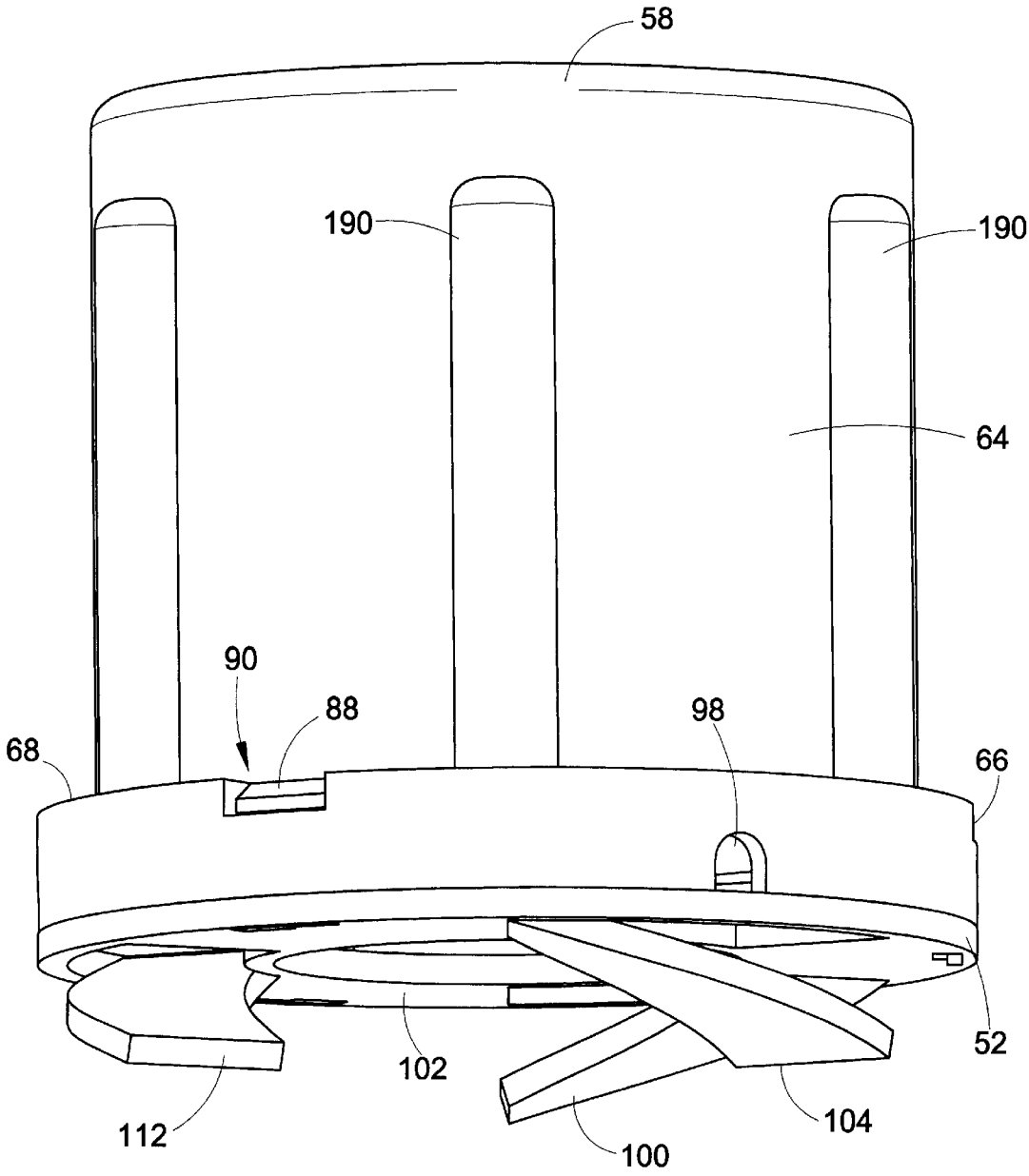
FIG. 3 is a perspective view of the assembled cap and tamper evident ring of FIG. 2.

As shown in FIG. 3, when assembled prior to use, the fingers 88 protrude outwardly from the cap and engage an outer surface 92 of the shelf portion adjacent the slot. Once assembled in this way, the tamper-evident ring 52 cannot readily be removed from the cap 50 without evidence of removal, primarily, by breaking or otherwise damaging one or more of the fingers 88 or other portions of the tabs 84. Additionally, once the assembled closure assembly 22 is threaded on to the outlet 16, the outlet is so close to the tabs that the tabs are unable to move inwardly enough to allow the fingers to pass through the slot and allow the ring to be separated from the cap.

When the cap is rotated, the ring 52 is constrained to move with the cap 50, due to engagement of the fingers with adjacent portions of the shelf around the slot. Openings 98 (FIG. 3) may be used by a customer to pry the ring 52 away from the cap 50, after breaking the tabs, using a suitable tool, such as a screwdriver.

With continued reference to FIGS. 2 and 3, annularly spaced protrusions in the form of resiliently flexible fins 100 (three are shown in FIGS. 2 and 3) extend from a second end surface 102 of the disk 80. In the embodiment of FIG. 2, the first and second surfaces are the opposite surfaces (i.e., top and bottom in FIG. 2) of the disk. The fins are preferably formed from cutout portions of the disk itself by cutting three sides of each fin from the disk. The fins are then bent or otherwise molded so that they protrude from the disk 80 in a generally opposite direction to the tabs. Alternatively, the fins 100 may be separately formed and attached to the disk, for example, by welding or adhesive, or may be otherwise formed to protrude from the disk.

The fins each provide a sliding surface 104, which extends away from the disk at a shallow angle. The sliding surfaces 104 contact an outer surface 108 of the valve body as the cap and ring assembly is screwed onto the outlet during the closing operation (e.g., in a clockwise direction C). As the cap reaches its fully closed position (e.g., with the top engaging the outlet around the opening 24 or with the threads 72, 74 fully engaged) the fins flex inwardly slightly as they come into contact with the outer surface of the valve. Specifically, the sliding surfaces slide over a portion of the valve body which is generally perpendicular to the threaded portion 74, such as a land 110 which protrudes slightly from the outer surface of the valve bore. As the cap reaches its fully closed position the fins are constrained to flex inwardly slightly (i.e., towards the cap) as they come into contact with the land, building up an opposing tension force in the fins.

Figure 4:
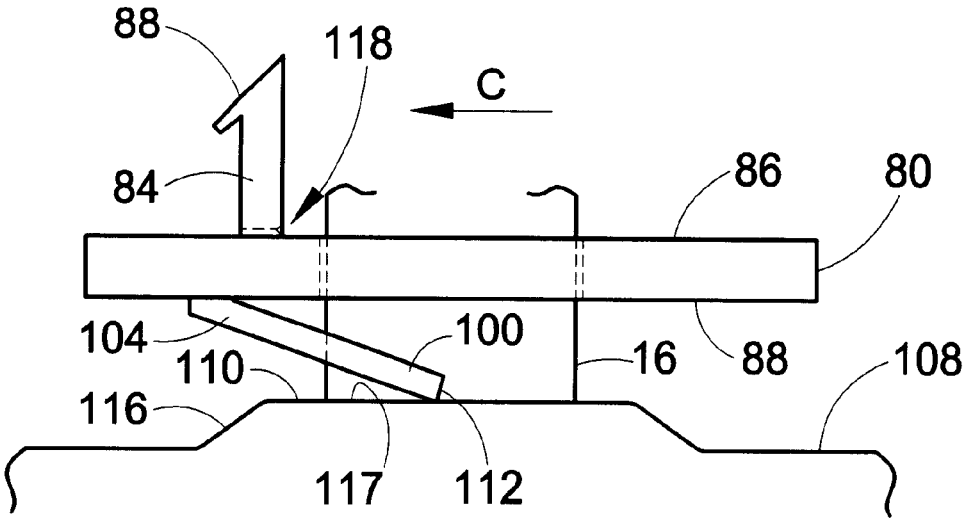
FIG. 4 is a side schematic view of the tamper evident ring of FIG. 2 during threading of the ring onto the outlet.
Figure 5:
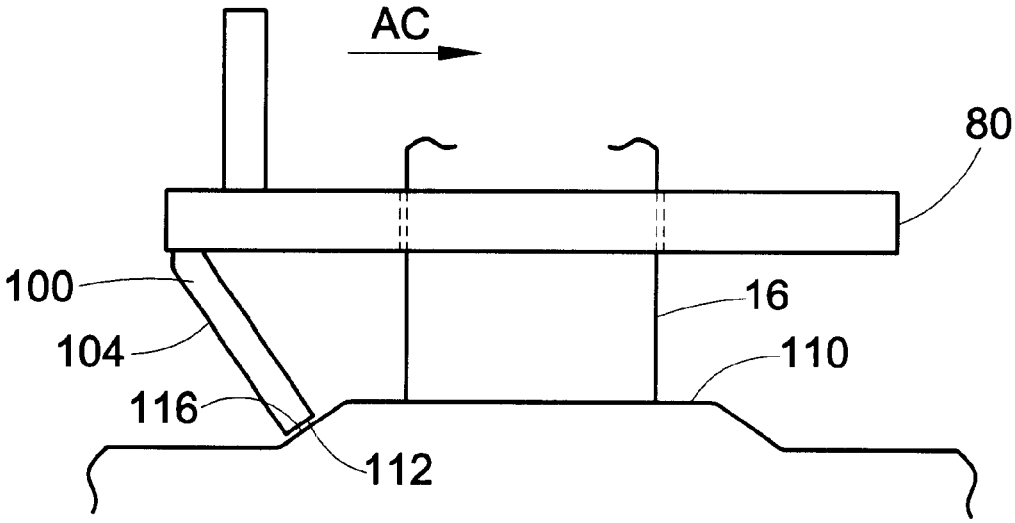
FIG. 5 a side schematic view of the tamper evident ring of FIG. 4 during rotation of the ring in a cap removal direction showing a projection engaging a land on the outlet.

With reference also to FIG. 4, the fins 100 also each include an engagement surface 112 provided by the distal end of the fin, which extends generally vertically from the sliding surface. (For convenience, FIG. 4 shows only one tab and one fin.) When the cap is rotated in the opening direction (such as in a counter-clockwise direction AC) the engagement surfaces 112 engage side surfaces 116 of the land (FIG. 5), inhibiting further counter-clockwise rotation of the cap. Specifically, the tension forces built up in the fins when brought into contact with the land during the closing operation cause the fins to spring outwards, away from the cap, as the fins reach the end of a sliding surface 117 of the land. When the cap turning direction is reversed, the fins are no longer able to cam on all the surfaces of the land as the engagement portions are angled to abut the side surfaces of the land without sliding over them. Not all of the engagement surfaces 112 of the fins need to engage the land in this step, as long as at least one of the engagement surfaces does. The force developed by engagement of the fins with the side surfaces of the land is in an opposite direction to the force applied to the fingers by an attempted rotation of the cap.

At some point, when sufficient rotational force is applied to the cap in the cap removing direction, the opposing forces built up in the ring 52 cause fracture one or more of the components of the ring. Typically, it is the fingers 88 on the tabs which break, allowing the cap 50 to rotate freely and be unscrewed from the outlet 16. For this purpose the tabs may have a weakened, frangible portion 118 (FIG. 4) which provides a line of fracture. FIG. 4 shows this weakened portion to be where the tab meets the disk, although it is also contemplated that the weakened portion may be provided elsewhere on the tab, such as adjacent the fingers. Alternatively, the fins 100 may break off the disk, allowing the ring and cap to rotate together and be removed from the outlet. In this embodiment, the connection between the fins and the disk may be thinned to provide a weakened, frangible portion.

Once the tabs have severed (or sufficient ones of the tabs have severed) the cap can be unscrewed from the outlet. The cap can be removed from the tamper-evident ring 52. The ring can be disposed of by the consumer, having served its purpose. The absence of the ring can be taken as evidence by the supplier that the assembly has been removed at least once and that refrigerant may have been dispensed. In the event that a customer complains that the valve is faulty and has leaked prior to use, the supplier can examine the tank to see if the cap has been removed. This will be clearly evident from the fracture of the ring tabs, or fins, or absence of the ring altogether, which cannot be readily disguised by the consumer. If the ring is damaged or missing, the supplier has evidence that at some point the cylinder has been opened and that the refrigerant may have been discharged by opening the valve.

After the first opening, the consumer may dispose of the cap 50 or replace it on the outlet 16, with or without the ring 52, to cover the valve outlet after each portion of the refrigerant has been discharged. The cap can include a sealing element 120 (see FIG. 1), such as an o-ring or gasket, which engages the outlet outer surface 76 to provide a secondary seal in addition to the valve seal itself. The o-ring may be seated in an annular groove 122, formed in the inner surface 70 of the cap skirt.

If the supplier does not wish to use the tamper-evident ring, for example, when the materials supplied in the cylinder are relatively inexpensive, and therefore less likely to be subject to tampering, the ring may be dispensed with altogether and the cap used alone. The supplier therefore does not need to stock different types of cap and can decide at any point up to shipment whether to fit the tamper evident ring 52 with the cap or to use the cap alone.

Figure 6:
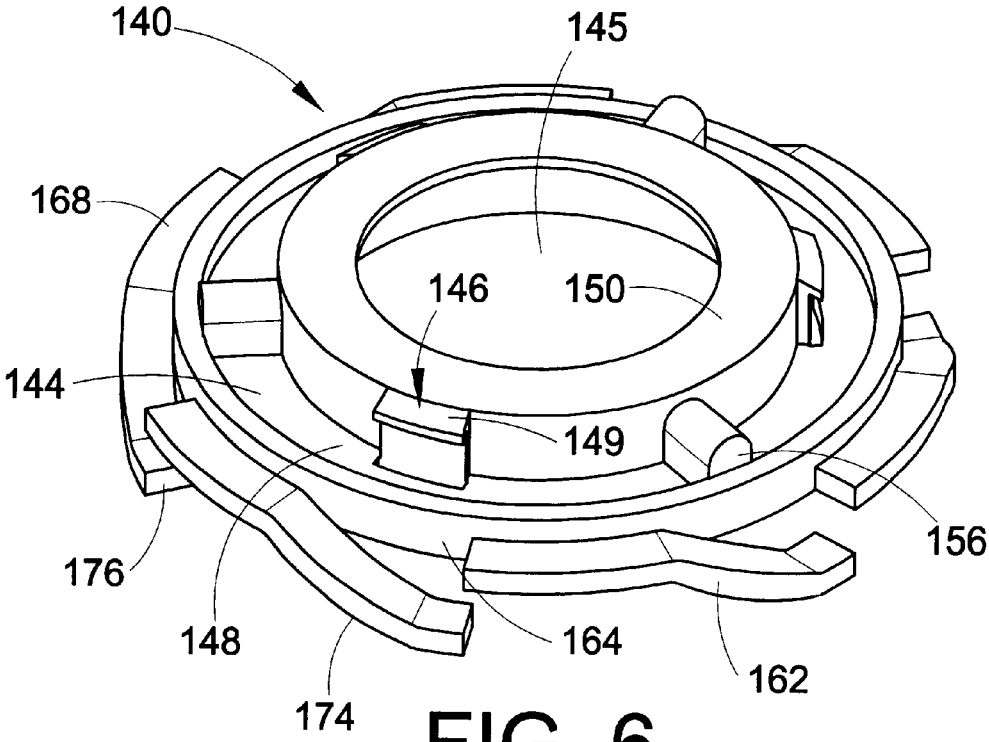
FIG. 6 is a top perspective view of a second embodiment of a tamper evident ring.
Figure 7:
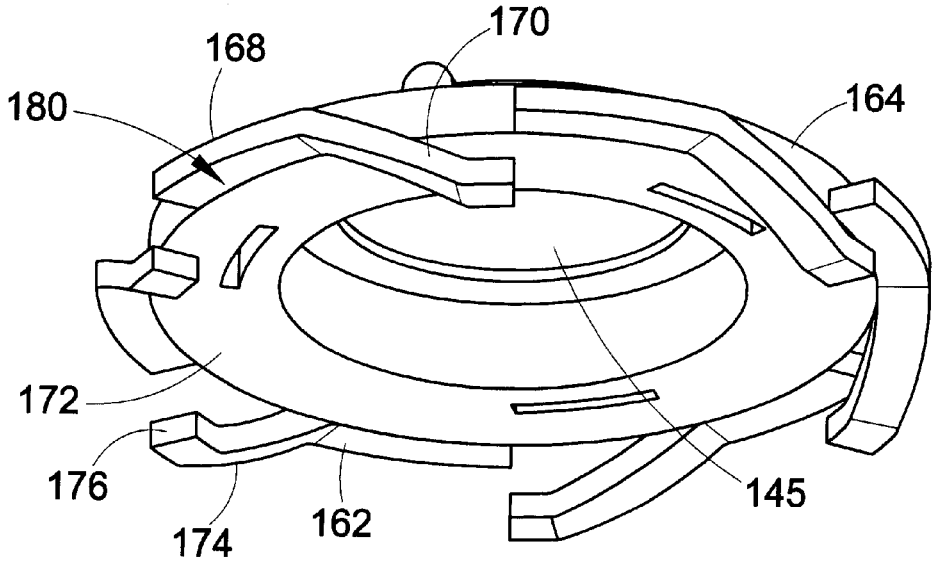
FIG. 7 is a bottom perspective view of the ring of FIG. 6.
Figure 8:
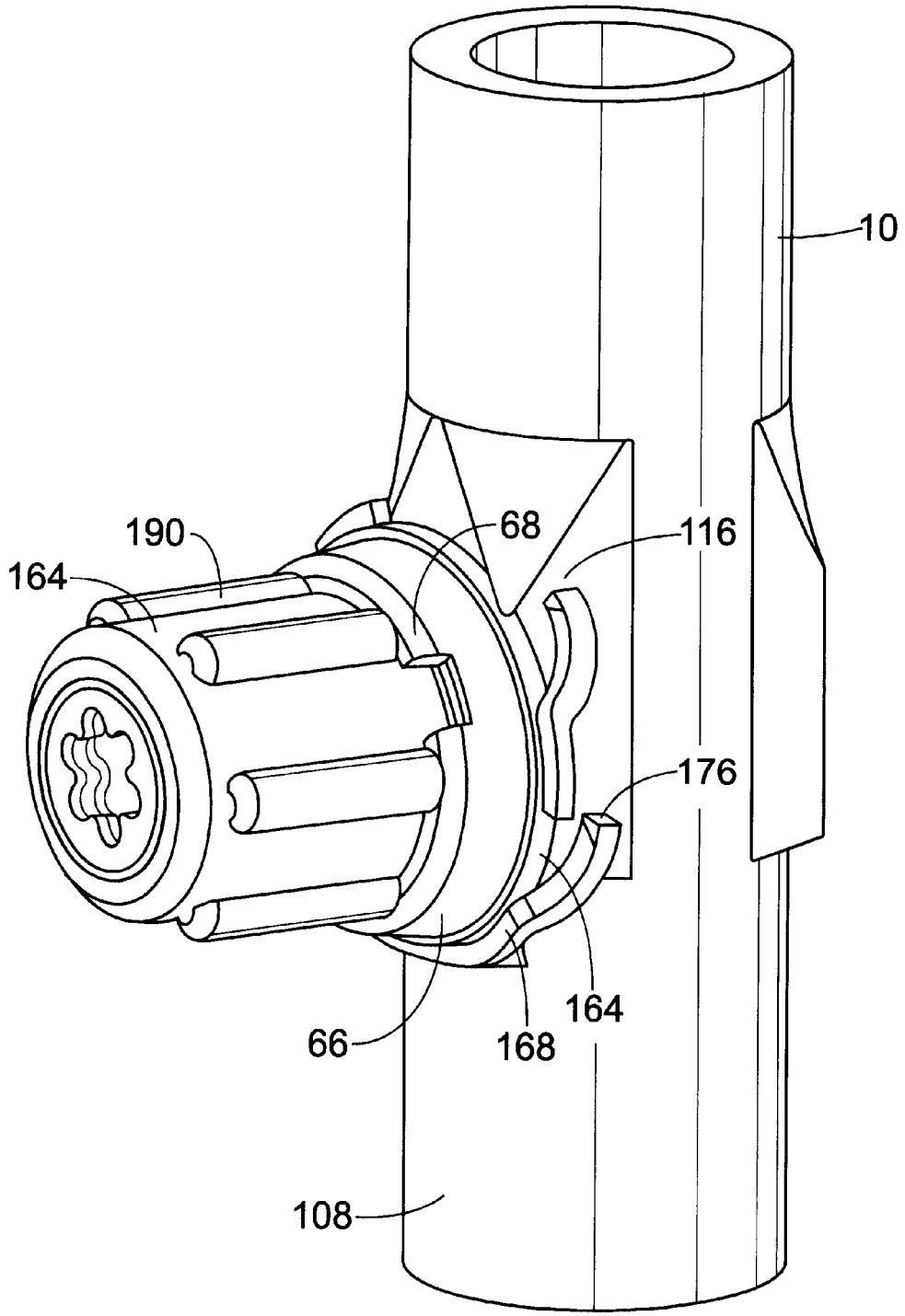
FIG. 8 is a perspective view of the closure assembly comprising the ring of FIGS. 6 and 7 fitted to a valve outlet.

With reference to FIGS. 6 and 8, a second embodiment of a tamper-evident ring 140 is shown. The ring is similar to that shown in FIGS. 1–5, in that it includes an annular disk 144 having a central aperture 145 with tabs 146 protruding from one end surface 148 of the disk. The tabs have outwardly extending fingers 149 as in the tabs of the first embodiment. In this embodiment, the tabs are optionally integrally formed with, and extend radially outwardly from an annular rib 150, which extends from the surface 148. The rib inhibits the tabs from being levered inwards and released from the slots after assembly. Knobs 156 are also provided. In this embodiment, fins 162 (six are shown in FIG. 6) are arranged around a peripheral rim 164 of the disk so that they extend circumferentially from the disk. The fins 162 each include a first portion 168, attached to the disk, which runs generally level with the disk, and a second, projecting portion 170, which extends away from a second end surface 172 of the disk (in FIGS. 6 and 7, the end surfaces 148, 172 are the upper and lower surfaces of the disk, respectively).

As in the fins of FIGS. 1–5, the projecting portions each include a sliding surface 174 and an engagement surface 176, although in this embodiment, the sliding surfaces are curved rather than straight. The fins may be formed from a single annular ring of material on the outer edge of the disk by forming cut-outs in the material corresponding to the engagement portions 176 and cutting the connection between the projecting portion 170 and the disk 144. The projecting portions can then be bent or molded into the shape as shown in FIGS. 6–7, or may be angled away from the disk, as for the fins of FIGS. 1–5. The fins may be formed with a thinned frangible region 180 intermediate the disk and the first portion.

As for the prior embodiment of the ring, the ring 140 may be used with the cap 50 in the same manner as previously described. When the cap is turned in the removal direction, one or more of the engagement surfaces 176 engage the land. When sufficient rotational force is applied, the fins break away from the ring at the frangible portion. The cap and ring can then be removed form the outlet.

As shown in FIGS. 2–3, and 8, the cap 50 may include vertically extending ribs 190, which are circumferentially spaced around first wall portion 64 of the cap skirt. The ribs are gripped by a user to aid in removal of the cap.

Figure 9:
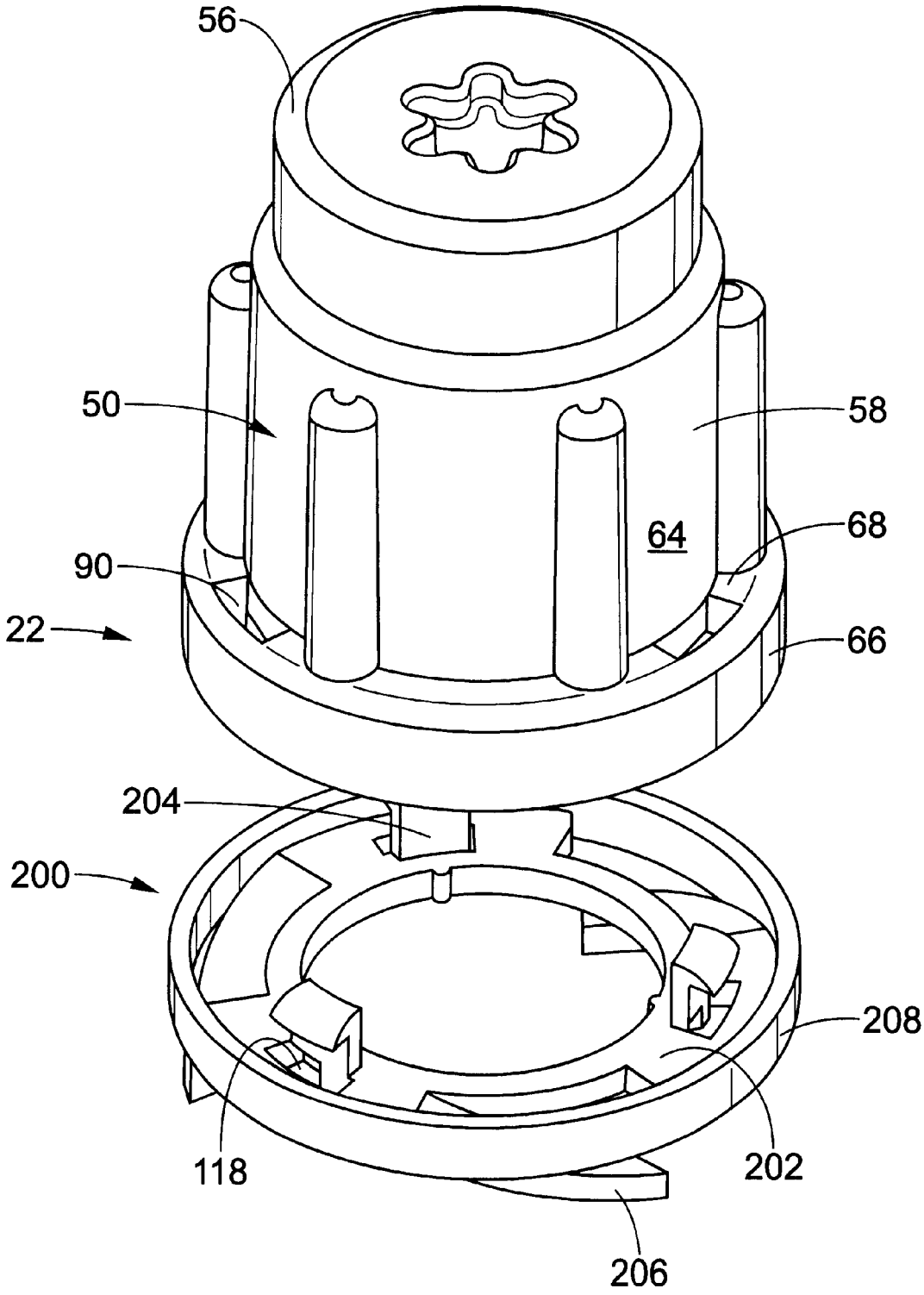
FIG. 9 is an exploded perspective view of a third embodiment of a closure assembly according to the present invention.

With reference now to FIG. 9, a third embodiment of a tamper-evident ring 200 is shown. The ring fits the same cap and outlet as shown in the earlier embodiments. The ring is similar to ring 52, in that it has a disk portion 202, tabs 204, and fins 206. In this embodiment, an annular flange 208 extends from the disk portion at a peripheral edge thereof, in a direction generally parallel with the tabs and spaced outwardly therefrom. The flange helps to protect the tabs from accidental breakage prior to assembly of the closure assembly. The flange also acts as an additional anti-tampering feature. The flange surrounds the wider wall portion 66 of the cap when the ring is connected with the cap. The flange 208 thus inhibits a customer from inserting a tool, such as a screwdriver, through the cap opening 60 and levering the tabs inwardly to release the tabs from the slots.

Figure 10:
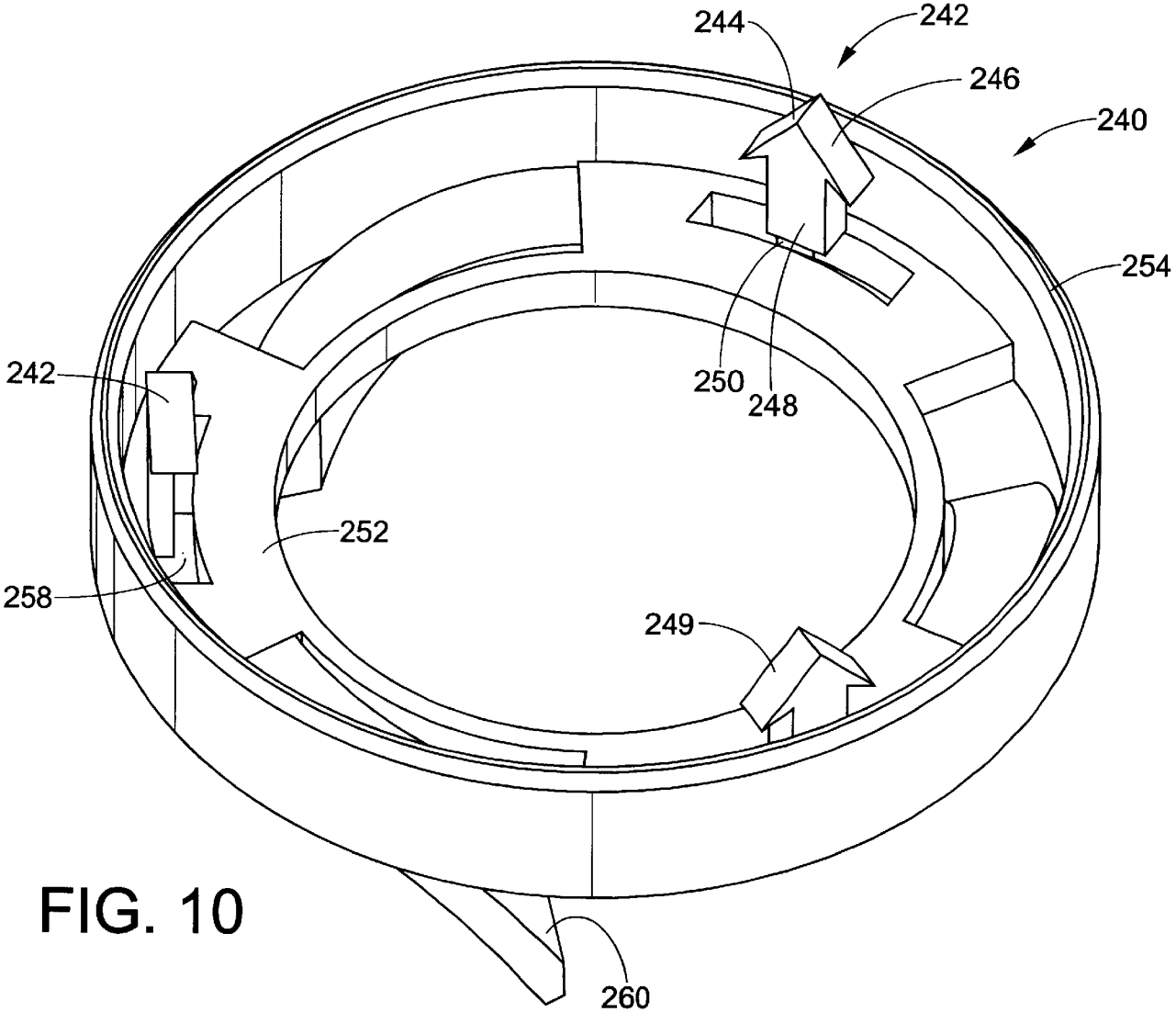
FIG. 10 is a top perspective view of a fourth embodiment of a tamper evident ring.
Figure 11:
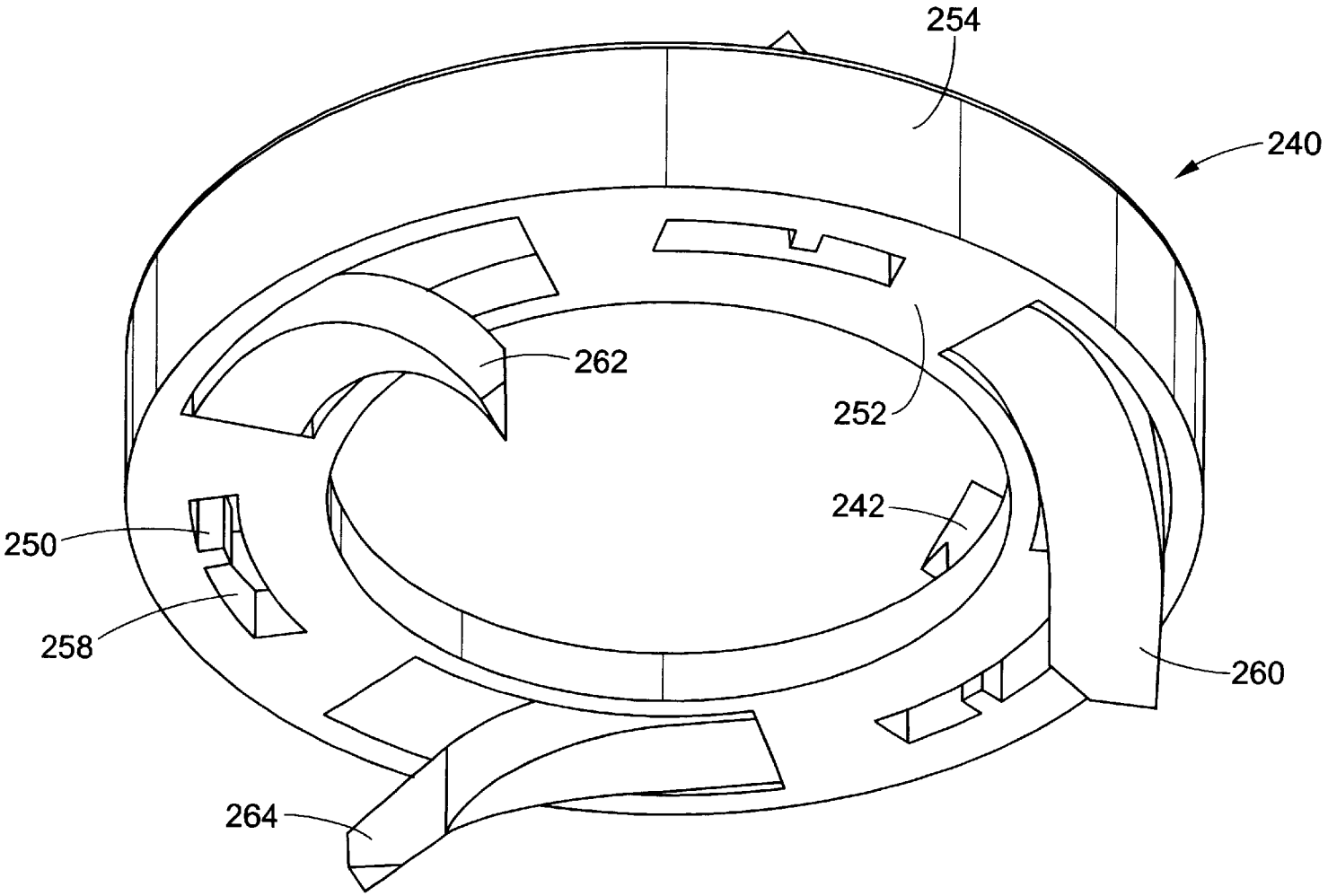
FIG. 11 is a bottom perspective view of the ring of FIG. 10.

With reference now to FIGS. 10 and 11, a fourth embodiment of a tamper evident ring 240 is shown. The ring can be used with the cap 50 shown in FIG. 1. The ring 240 is similar to the ring 200 of FIG. 9. However, tabs 242 are in the shape of arrowheads. In this embodiment, two fingers 244, 246 extend from either side of a shaft 248 to define the top of the arrowhead. Distal tips 249 of the fingers are pressed inwardly, towards the shaft, as the tabs are inserted into their respective slots in the cap. The fingers then snap outwardly again once they have passed through the slot. The two fingers thus sit on a shoulder 68 (FIG. 2) of the cap when inserted through slots 90 (FIG. 2). Because two fingers are used in place of one, it is difficult to dislodge the fingers from the shoulder without breaking the tabs. This makes it even more difficult for someone to tamper with the cap.

A narrowed portion 250 of the shaft 248 connects the shaft to a disk portion 252 of the ring and provides a frangible portion. The narrowed portion 250 is readily broken when the cap is rotated or pulled upwardly relative to the ring. For example, if the cap is pulled away from the ring, the distal tips 249 splay outwardly, engaging the adjacent cap shoulder, and do not pass back through the slot again. Rather, the force applied eventually breaks the frangible portion 250 of the tab. As with the prior embodiment, an annular flange 254 extends from the disk portion 252 at a peripheral edge thereof, in a direction generally parallel with the tabs and spaced outwardly therefrom. As is best shown in FIG. 11, the narrowed portion 250 of the shaft is surrounded on three of its sides by a cut out 258 portion of the disk. The shaft is thus connected with the disk along only one of its vertical sides, which aids in breaking the shaft away from the disk.

Fins 260, analogous to fins 100 (FIG. 2), extend from the disk portion 252, in an opposite direction to the tabs and flange, for engaging the land on the valve outlet. In this embodiment, however, distal tips 262 of the fins are angled to provide a vertical surface 264 which engages the land more closely than in the prior embodiment.

In use, a gas cylinder is filled with gas and the outlet 18 closed by turning the valve handle 34, to seal the gas in the cylinder. The supplier takes the preformed cap 50 and any of the rings 52, 140, 200, 240 and snap fits the ring to the cap to form the closure assembly 22. The closure assembly 22 is then threaded on to the outlet 16 of the gas cylinder until the sliding surfaces of the fins contact the land. Both of these latter operations can be done by hand or automatically, by one or more machines. The supplier may back off the cap until the fin engagement portions just engage the side surfaces of the land to minimize any tension forces developed in the fins, or may simply leave the sliding surfaces in contact with the land. The gas cylinders are then ready to be shipped to the customer.

The customer preferably leaves the closure assembly 22 on the outlet 16 until ready to dispense gas to provide an additional seal to the outlet and/or dust protection for the outlet. Once ready to dispense gas, the customer applies an unthreading force to the cap 50 which snaps the tabs 84, 146, 204, 242 (or other portion of the ring 52 140, 200, 240) and allows the cap to be removed from the outlet 16. The customer then dispenses gets from the cylinder in the conventional way, for example, by fitting a gas supply line (not shown) which has a threaded interior surface that matches the thread 74 on the outlet and opening the valve assembly 10 by turning the handle 34. After some of the gas has been dispensed, the customer may close the valve once more and remove the gas supply line from the outlet. At this point, the customer may replace the cap on the outlet to provide dust protection for the outlet while the cylinder is not in use and/or provide an additional seal to inhibit leakage of gas from the cylinder.

While in the instant application the embodiments all illustrate one or more tabs on a tamper evident ring extending into one or more slots in a cap, it is within the scope of the invention to locate one or more tabs on the cap and provide at least one of the slots on the tamper-evident ring.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the preferred embodiments, the invention is now claimed to be:

1. A tamper-evident closure for an outlet, the closure comprising:

a cap which rotatably engages an associated outlet; and a tamper evident ring carried by the cap and having at least one projection, rotation of the cap in a cap removal direction being opposed by engagement of the at least one projection with a surface of the associated outlet until at least one of a portion of the ring and a portion of the cap breaks, allowing the cap to be removed from the associated outlet, wherein the portion of the ring or cap which breaks includes at least one tab on the ring or the cap which snap fits into at least one slot on the other of the ring and the cap.

2. The tamper-evident closure of claim 1, wherein the at least one tab includes a plurality of tabs.

3. The tamper-evident closure of claim 1, wherein the at least one tab has an arrow-shaped distal end.

4. The tamper-evident closure of claim 1, wherein the at least one tab defines fingers which are depressed towards a shaft when the at least one tab is snap fit into the at least one slot on the cap and spring outwardly to engage an adjacent shoulder of the cap when the fingers have passed through the at least one slot, thereby resisting a force applied to pull the at least one tab back through the at least one slot.

5. The tamper-evident closure of claim 1, wherein the at least one projection includes a plurality of projections.

6. The tamper-evident closure of claim 1, wherein the engagement of the at least one tab with the cap opposes rotation of the cap relative to the ring during rotation of the cap in the cap removal direction until a sufficient rotational force is applied to break the tabs.

7. The tamper-evident closure of claim 1, further including a seal retained in a groove defined on an inner surface of the cap, the seal sealing the cap to the outlet.

8. The tamper-evident closure of claim 1, wherein the cap includes a threaded portion on an inner surface thereof for engagement with a threaded portion on the outlet.

9. The tamper-evident closure of claim 1, wherein the at least one tab includes at least one finger located at a distal end of the tab, said at least one finger passing through the at least one slot.

10. The tamper-evident closure of claim 9, wherein the at least one finger includes two fingers.

11. The tamper-evident closure of claim 1, wherein the tamper-evident ring includes a disk portion with a central aperture for receiving the outlet therethrough.

12. The tamper-evident closure of claim 11, wherein the at least one tab extends from a first surface of the disk and the at least one projection extends from a second surface of the disk.

13. The tamper-evident closure of claim 12, wherein the at least one projection is formed from a cut-out portion of the disk.

14. The tamper-evident closure of claim 12, further including:

an annular flange which extends from the same surface of disk as the at least one tab.

15. The tamper-evident closure of claim 14, wherein the annular flange is received around the cap when the ring is carried by the cap.

16. The tamper-evident closure of claim 12, wherein the second surface is opposite to the first surface.

17. The tamper-evident closure of claim 16, wherein the at least one projection includes a sliding portion and an engagement portion.

18. The tamper-evident closure of claim 17, wherein the sliding portion slides over a portion of a valve body when the cap is rotated in a cap engagement direction, the engagement portion engaging the valve body portion when the cap is rotated in a cap removal direction.

19. A combination of a closure assembly and a valve assembly comprising:

a valve assembly comprising a valve body and an outlet extending generally perpendicular to the valve body, the outlet having an internal bore with an opening for dispensing a fluid therefrom and a land on an exterior surface thereof, the valve body having an internal bore which is fluidly connected with the internal bore of the outlet, a sealing member received within the valve body internal bore for selectively closing a fluid connection between the valve body and the outlet internal bore;

a closure assembly comprising:

a cap configured for attachment to the outlet of the valve body so as to cover the opening; and, a tamper-evident ring operatively connected with the cap by at least one tab, which is located on one of the ring and the cap, the ring including at least one projection for engaging the land on the outlet to resist removal of the cap from the outlet until movement of the cap in a cap removal direction breaks one of the at least one tab and the at least one projection.

20. The combination of claim 19, wherein the at least one tab includes a plurality of tabs, and wherein at least one of the tabs is broken by movement of the cap in a cap removal direction, thereby allowing the cap to be operatively disconnected from the tamper evident ring.

21. A method of providing evidence of removal of a cap from an outlet, the method comprising:

engaging a tab on a ring with a slot on the cap, the engagement preventing rotation of the cap relative to the ring without breaking the tab;

rotatably engaging the cap with the outlet until at least one projection carried by the ring contacts a surface of the outlet, the projection resisting rotation of the cap in a cap removal direction; and, applying a sufficient force to the cap in the cap removal direction to cause the tab to break, allowing the cap to be removed from the outlet.

22. The method of claim 21, further including the step of:

providing an annular flange on the ring which inhibits unauthorized tampering with the at least one tab.

23. A tamper-evident closure for an outlet, the closure comprising:

a cap which rotatably engages the outlet, the cap including a slot;

a tamper evident ring including:

a tab, the tab including a frangible portion and at least one finger, the finger snap fitting into the slot on the cap, and a projection, rotation of the cap in a cap removal direction being opposed by engagement of the projection with a surface of the outlet until the frangible portion of the tab breaks, allowing the cap to be removed from the outlet.

* * * * *